US009425561B2

(12) United States Patent
Kim et al.

(10) Patent No.: US 9,425,561 B2
(45) Date of Patent: Aug. 23, 2016

(54) HIGH VOLTAGE ELECTRICAL CONNECTOR

(71) Applicants: Hyundai Motor Company, Seoul (KR); Kia Motors Corporation, Seoul (KR); Tyco Electronics Amp Korea Ltd., Gyeongsan, Gyeongsangbuk-Do (KR)

(72) Inventors: Jeong Han Kim, Gyeonggi-Do (KR); Mun Jong Kim, Gyeonggi-Do (KR); Hyun Sang Park, Daegu (KR)

(73) Assignees: Hyundai Motor Company, Seoul (KR); Kia Motors Corporation, Seoul (KR); Tyco Electronics Amp Korea Ltd., Gyeongsan, Gyeongsangbuk-do (KR)

( * ) Notice: Subject to any disclaimer, the term of this patent is extended or adjusted under 35 U.S.C. 154(b) by 0 days.

(21) Appl. No.: 14/690,393

(22) Filed: Apr. 18, 2015

(65) Prior Publication Data

US 2016/0126679 A1 May 5, 2016

(30) Foreign Application Priority Data

Nov. 5, 2014 (KR) ..... 10-2014-0153161

(51) Int. Cl.
*H01R 13/6598* (2011.01)
*H01R 13/6592* (2011.01)

(52) U.S. Cl.
CPC ..... *H01R 13/6598* (2013.01); *H01R 13/6592* (2013.01)

(58) Field of Classification Search
USPC ..... 439/862, 65, 500, 188, 733.1, 79, 289, 439/575.2
See application file for complete search history.

(56) References Cited

U.S. PATENT DOCUMENTS

| | | | | |
|---|---|---|---|---|
| 7,264,508 | B2 * | 9/2007 | Sakakura et al. | 439/607.57 |
| 7,575,476 | B2 * | 8/2009 | Tyler et al. | 439/607.04 |
| 7,789,690 | B1 * | 9/2010 | Rhein | 439/310 |
| 7,811,115 | B1 * | 10/2010 | Tyler | 439/352 |
| 7,985,098 | B2 * | 7/2011 | De Chazal et al. | 439/620.31 |
| 7,988,482 | B2 * | 8/2011 | Kim et al. | 439/357 |
| 8,251,748 | B2 * | 8/2012 | Tyler et al. | 439/607.52 |
| 2004/0110425 | A1 * | 6/2004 | Miyake et al. | 439/677 |
| 2008/0220652 | A1 * | 9/2008 | Tyler | 439/610 |
| 2012/0028500 | A1 * | 2/2012 | Lee et al. | 439/607.01 |
| 2012/0108106 | A1 * | 5/2012 | de Chazal | 439/620.26 |
| 2012/0208400 | A1 * | 8/2012 | De Chazal et al. | 439/607.58 |

FOREIGN PATENT DOCUMENTS

| | | | |
|---|---|---|---|
| JP | 2013-519207 | A | 5/2013 |
| JP | 2013-229139 | A | 11/2013 |
| JP | 2013-232368 | A | 11/2013 |
| KR | 10-2009-0106422 | | 10/2009 |
| KR | 10-2009-0106422 | A | 10/2009 |
| KR | 10-2010-0104029 | A | 9/2010 |

* cited by examiner

*Primary Examiner* — ALexander Gilman
(74) *Attorney, Agent, or Firm* — Mintz Levin Cohn Ferris Glovsky and Popeo, P.C.; Peter F. Corless

(57) ABSTRACT

A high voltage electrical connector is provided that includes a plug assembly and a header that is coupled to the plug assembly. The plug assembly includes a housing that forms an appearance of the plug assembly and a plug that is inserted into the housing to be inserted into the header. In addition, the plug assembly includes a shielding cover that shields electromagnetic waves emitted from the plug, covers the plug, and is inserted into the housing.

10 Claims, 6 Drawing Sheets

HIGH VOLTAGE ELECTRICAL CONNECTOR

CROSS-REFERENCE TO RELATED APPLICATION

This application is based on and claims the benefit of priority to Korean Patent Application No. 10-2014-0153161, filed on Nov. 5, 2014 in the Korean Intellectual Property Office, the disclosure of which is incorporated herein in its entirety by reference.

TECHNICAL FIELD

The present disclosure relates to a high voltage electrical connector and, more particularly, to a high voltage electrical connector having improved electromagnetic wave blocking performance and a reduced weight.

BACKGROUND

A high voltage electrical connector is used to connect signal and power paths to components or connect signal and power paths from components. Efforts to reduce fuel costs and environmental pollution have led the automobile industry to develop electric vehicles and hybrid electric vehicles. Electric systems of automobiles include components that operate at a high voltage and require a high voltage path including a connector. A high voltage path and a connector are configured to transmit power between components. Electric systems also include components that operate at a low voltage and include a low voltage path and a connector. The low voltage path and the connector are configured to transmit a control signal between components. Since high voltage systems and low voltage systems are adjacent to each other, various connectors are required to be protected from electrical interference.

SUMMARY

The present disclosure has been made to solve the above-mentioned problems occurring in the prior art while advantages achieved by the prior art are maintained intact. Aspects of the present disclosure provide the following advantages:

First, a weight of a high voltage electrical connector may be reduced.

Second, electromagnetic waves generated in the high voltage electrical connector may be shielded.

Third, vibrations applied to the high voltage electrical connector may be absorbed.

Technical subjects of the present disclosure are not limited to the foregoing technical subjects and any other technical subjects not mentioned will be clearly understood by a skilled person in the art from the following description.

According to an exemplary embodiment of the present disclosure, a high voltage electrical connector may include a plug assembly and a header coupled to the plug assembly, wherein the plug assembly may include a housing that forms an appearance; a plug inserted into the housing to be inserted into the header; and a shielding cover that shields electromagnetic waves emitted from the plug, covers the plug, and is inserted into the housing.

According to another exemplary embodiment of the present disclosure, a high voltage electrical connector may include a plug assembly and a header coupled to the plug assembly, wherein the plug assembly may include a housing that forms an appearance; a plug inserted into the housing to be inserted into the header; a shielding cover that shields electromagnetic waves emitted from the plug and having an elastically deformable ground protrusion that protrudes from the edge to fix the header; and a rear cover coupled to a rear end of the housing and pushing the shielding cover in a direction toward the header.

Specific matters of other exemplary embodiments are included in the detailed description and drawings.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
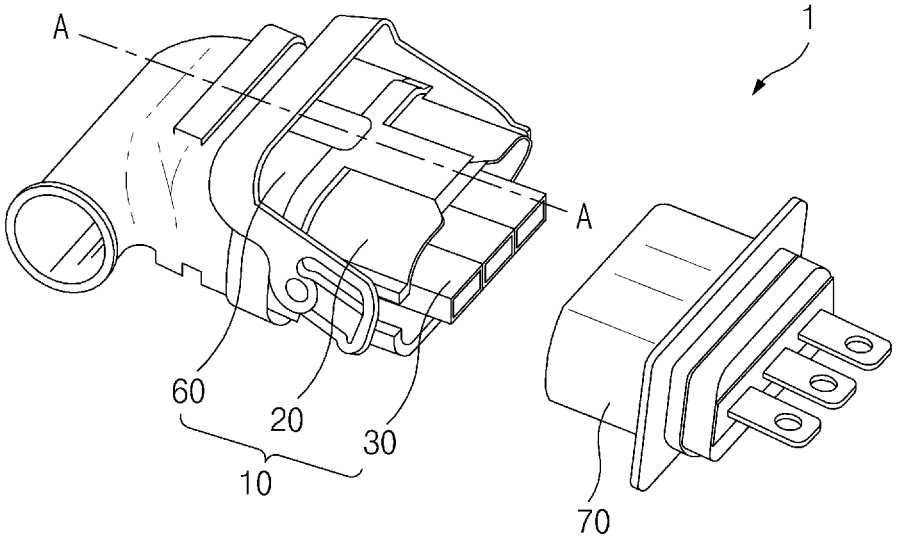
FIG. 1 is an exemplary view of a high voltage electrical connector according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/of" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Advantages and features of the present disclosure, and implementation methods thereof will be clarified through following exemplary embodiments described with reference to the accompanying to drawings.

The present disclosure may, however, be embodied in different forms and should not be construed as limited to the exemplary embodiments set forth herein. Rather, these exemplary embodiments are provided so that this disclosure will be thorough and complete, and will fully convey the scope of the present disclosure to those skilled in the art. Further, the present disclosure is only defined by scopes of claims. Like reference numerals refer to like elements throughout.

Figure 2:
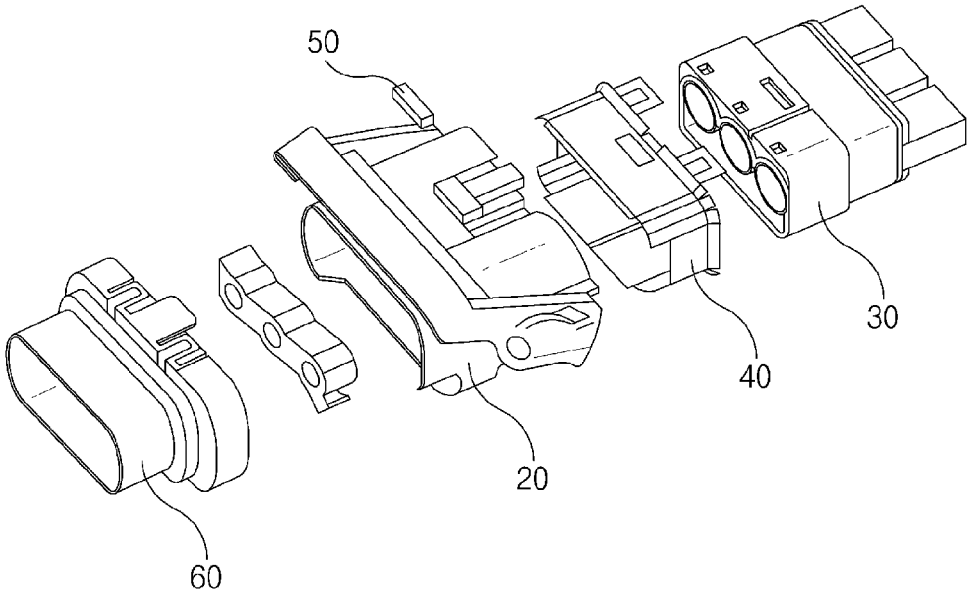
FIG. 2 is an exemplary detailed view of the high voltage electrical connector according to an exemplary embodiment of the present disclosure.
Figure 3:
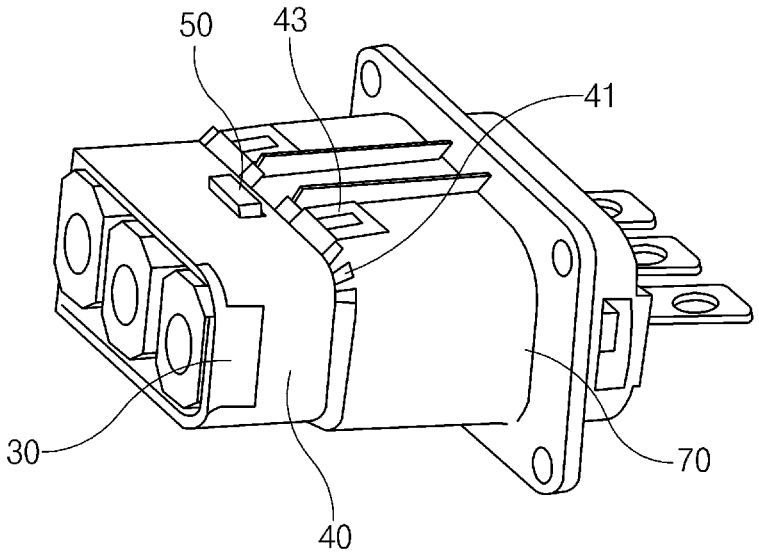
FIG. 3 is an exemplary view of a plug assembly according to an exemplary embodiment of the present disclosure.

Hereinafter, a high voltage electrical connector 1 according to exemplary embodiments of the present disclosure will be described with reference to the accompanying drawings. FIG. 1 is an exemplary view of a high voltage electrical connector 1 according to an exemplary embodiment of the present disclosure. FIG. 2 is an exemplary detailed view of the high voltage electrical connector 1 according to an exemplary embodiment of the present disclosure. FIG. 3 is an exemplary view of a plug assembly 10 according to an exemplary embodiment of the present disclosure.

Referring to FIGS. 1 through 3, the high voltage electrical connector 1 according to an exemplary embodiment of the present disclosure may include a plug assembly 10 and a header 70 coupled to the plug assembly 10. The plug assembly 10 may include a housing 20 that forms an appearance (e.g., forms the shell of the plug assembly), a plug 30 inserted into the housing 20 to be inserted into the header 70, and a shielding cover 40 that shields electromagnetic waves emitted from the plug 30, covers the plug 30, and is inserted into the housing 20. The header 70 may be formed of aluminum, coupled to the plug 30, and may contact the shielding cover 40 to block leakage of electromagnetic waves.

The housing 20 may be formed of plastic, may receive the plug 30 inserted therein, and the housing 20 may be coupled to the header 70 with a lever coupled to an outer portion of the housing 20, serving as an external case. The shielding cover 40 may be an electromagnetic interference (EMI) shielding mechanism formed of a thin metal plate member. The plug 30 may be coupled to a connector within the header 70 disposed adjacent to a motor. The shielding cover 40 may be a plate member formed of a metal, and the housing 20 may be formed of plastic.

The shielding cover 40 may include a radial protrusion 41 that protrudes from the edge of the shielding cover 40 to block electromagnetic waves leaked to a gap with the header 70. The radial protrusion 41 may overlap with the header 70 in a predetermined portion to block electromagnetic waves leaked to a gap between the header 70 and the plug 30. When the plug assembly 10 and the header 70 are coupled, the header 70 may contact (e.g., may touch, abut, or the like) the radial protrusion 41 of the shielding cover 40. In particular, the radial protrusion may have predetermined elastic force, allowing the header 70 to be safely brought into contact with the shielding cover 40. Accordingly, leakage of electromagnetic waves may be minimized in spite of the gap that may be generated during manufacturing and assembling process of the connector.

Figure 4:
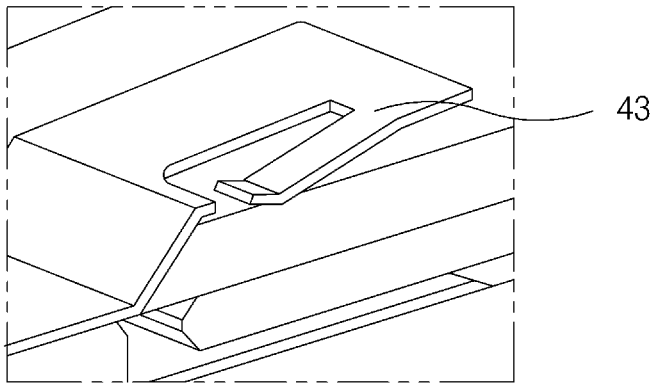
FIG. 4 is an exemplary detailed view of a ground protrusion of FIG. 1 according to an exemplary embodiment of the present disclosure.

FIG. 4 is an exemplary detailed view of a ground protrusion 43 of FIG. 1. Referring to FIG. 4, the shielding cover 40 may have an elastically deformable ground protrusion 43 that protrudes from the edge to fix the header 70. The ground protrusion 43 and the radial protrusion 41 may be elastically deformable. Additionally, a plurality of ground protrusions 43 and protrusions 41 may be formed on the edges of the shielding cover 40. Thus, the radial protrusions 41 and the ground protrusions 43 may be configured to absorb vibrations in an axial direction of the plug 30 and vibrations in a height direction of the plug 30.

Figure 5:
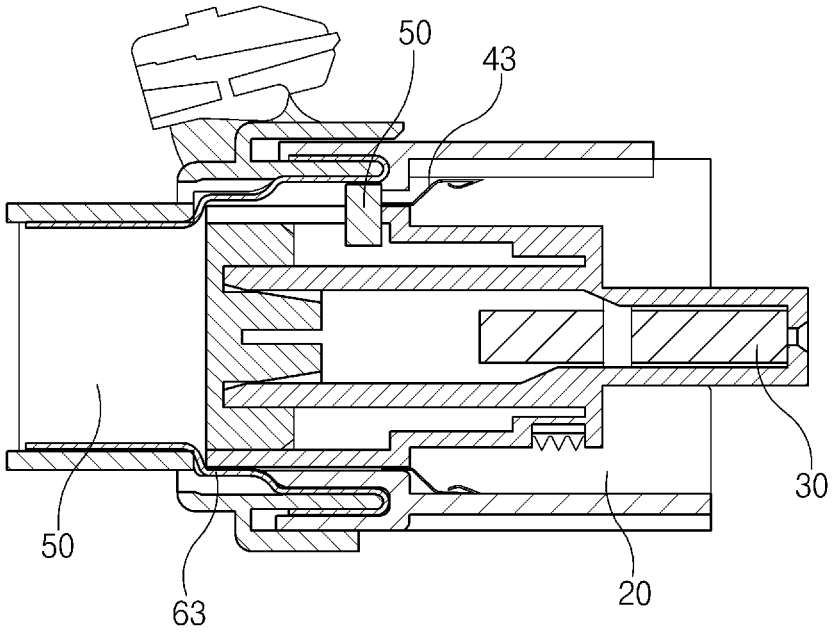
FIG. 5 is an exemplary cross-sectional view taken along line A-A of FIG. 1 according to an exemplary embodiment of the present disclosure.

FIG. 5 is an exemplary cross-sectional view taken along line A-A of FIG. 1. Referring to FIG. 5, the high voltage electrical connector 1 according to an exemplary embodiment of the present disclosure may include a coupling member 50 inserted into the plug 30 by penetrating through the housing 20 and the shielding cover 40. The coupling member 50 may be coupled to an upper portion of the housing 20, and may be configured to prevent a relative movement of the housing 20, the shielding cover 40, and the plug 30. One side (e.g., a first side) of the coupling member 50 may be inserted into the plug 30 and the other side (e.g., a second side) of the coupling member 50 may be in contact with (e.g., may abut) a cable shield 63 to fix the cable shield 63 to the rear cover 60.

The high voltage electrical connector 1 according to an exemplary embodiment of the present disclosure may include a rear cover 60 inserted into a rear side of the housing 20 to push the shielding cover 40 in a direction toward the header 70. The rear cover may be coupled to the rear side of the housing 20 and may be configured to push the shielding cover 40 in a forward direction. Thus, the shielding cover 40 may be pushed in the direction toward the header 70. The pushing force allows the header 70 and the shielding cover 40 to be more stably in elastic contact. In addition, an electromagnetic wave blocking effect may increase.

The high voltage electrical connector 1 according to an exemplary embodiment of the present disclosure may include a cable shield 63 inserted into an interior of the rear cover 60 to establish a ground. The shielding cover 40 may be continuously exposed to electromagnetic waves. In particular, an eddy current, an induced current, and the like, may be generated in each component due to electromagnetic waves. When such a current is not effectively removed, electrical performance of a product may be affected or the security of a service worker or an operator of a product may be threatened. Thus, to effectively remove an eddy current, an induced current, and the like, the cable shield 63 may be included in the assembly.

When the plug assembly 10 and the header 70 are coupled, upper and lower sides may need to be distinguished due to electrical characteristics or structural characteristics. In the present disclosure, when the plug assembly 10 and the header 70 are coupled in a manner different from a designer's intention, the header 70 and the plug 30 may not be easily coupled, thus preventing erroneous coupling.

Figure 6:
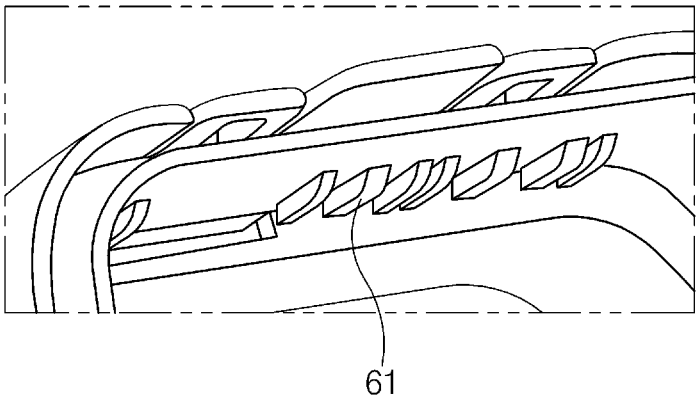
FIG. 6 is an exemplary view illustrating tightly attaching protrusions formed within a rear cover according to an exemplary embodiment of the present disclosure.

FIG. 6 is an exemplary view illustrating tightly attaching protrusions 61 formed within the rear cover 60 according to an exemplary embodiment of the present disclosure. Referring to FIG. 6, the rear cover 60 may include the attaching protrusions 61 that protrude from the inside to attach the cable shield 63 to the shielding cover 40 (e.g., to fix the cable shield 63 to the shielding cover 40).

One side (e.g., a first side) of the coupling member 50 may be inserted into the plug 30 and the other side (e.g., a second side) of the coupling member 50 may abut the cable shield 63, thus fixing the cable shield 63 to the rear cover 60. In a high voltage electrical connector 1 according to an exemplary embodiment of the present disclosure including a plug assembly 10 and a header 70 coupled to the plug assembly, the plug assembly 10 may include a housing 20 that forms an appearance (e.g., forms the shell of the assembly); a plug 30 inserted into the housing 20 to be inserted into the header 70; a shielding cover 40 that shields electromagnetic waves emitted from the plug 30 (e.g., protects the assembly from the electromagnetic waves) and having an elastically deformable ground protrusion 43 that protrude from the edge to fix the header 70;

and a rear cover 60 coupled to a rear end of the housing 20 and pushing the shielding cover 40 in a direction toward the header 70.

According to the high voltage electrical connector 1 according to the present disclosure, a product manufactured through dicasting may be formed of plastic, thus reducing a weight of the product. Additionally, the plastic component may have an electromagnetic (EMI) shielding function. The joint between the connector and the header 70 may be configured to perform EMI shielding by a simplified structure. The high voltage electrical connector may have a vibration absorption structure. Further, the plug 30, the shielding cover 40, and the housing 20 may be assembled to have a simplified structure. Thus, assembly efficiency may be enhanced to secure productivity.

According to the present disclosure, the following advantages are obtained:

First, a weight of the high voltage electrical connector may be reduced.

Second, electromagnetic waves generated by the high voltage electrical connector may be shielded.

Third, vibrations applied to the high voltage electrical connector may be absorbed.

The advantages and effects of the present disclosure are not limited to the aforesaid, and any other advantages and effects not described herein will be clearly understood by those skilled in the art from descriptions of claims.

The present disclosure described above may be variously substituted, altered, and modified by those skilled in the art to which the present disclosure pertains without departing from the scope and spirit of the present disclosure. Therefore, the present disclosure is not limited to the above-mentioned exemplary embodiments and the accompanying drawings.

What is claimed is:

1. A high voltage electrical connector comprising:
a plug assembly; and
a header coupled to the plug assembly,
wherein the plug assembly includes:
a housing that forms an appearance of the plug assembly;
a plug inserted into the housing to be inserted into the header;
a shielding cover that shields electromagnetic waves emitted from the plug, covers the plug, and is inserted into the housing; and
a coupling member inserted into the plug by penetrating through the housing and the shielding cover.

2. The high voltage electrical connector according to claim 1, wherein the shielding cover is a plate member formed of a metal and the housing is formed of plastic.

3. The high voltage electrical connector according to claim 1, wherein the shielding cover has a radial protrusion that protrudes from an edge of the shielding cover and shields electromagnetic waves leaked to a gap with the header.

4. The high voltage electrical connector according to claim 1, wherein the shielding cover has an elastically deformable ground protrusion that protrudes from an edge of the shielding cover to fix the header.

5. The high voltage electrical connector according to claim 1, further comprising:
a rear cover inserted into a rear side of the housing and pushing the shielding cover in a direction toward the header.

6. The high voltage electrical connector according to claim 5, further comprising:
a cable shield inserted into an interior of the rear cover to establish a ground.

7. The high voltage electrical connector according to claim 6, wherein the rear cover has an attaching protrusion that protrudes from an inside to fix the cable shield to the shielding cover.

8. The high voltage electrical connector according to claim 6, wherein a first side of the coupling member is inserted into the plug and a second side of the coupling member abuts the cable shield to fix the cable shield to the rear cover.

9. A high voltage electrical connector, comprising:
a plug assembly; and
a header coupled to the plug assembly,
wherein the plug assembly includes:
a housing that forms an appearance of the plug assembly;
a plug inserted into the housing to be inserted into the header;
a shielding cover that shields electromagnetic waves emitted from the plug and has an elastically deformable ground protrusion that protrudes from an edge of the shielding cover to fix the header;
a rear cover coupled to a rear end of the housing and pushing the shielding cover in a direction toward the header; and
a coupling member inserted into the plug by penetrating through the housing and the shielding cover.

10. An environmentally-friendly vehicle having the high voltage electrical connector of claim 9.

* * * * *